US007367787B2

(12) United States Patent
Arbogast

(10) Patent No.: US 7,367,787 B2
(45) Date of Patent: May 6, 2008

(54) PUMPING UNIT FOR A LIQUID MEDIUM

(75) Inventor: Franz Arbogast, Heidenheim (DE)

(73) Assignee: Voith Turbo GmbH & Co. KG, Heidenheim (DE)

( * ) Notice: Subject to any disclaimer, the term of this patent is extended or adjusted under 35 U.S.C. 154(b) by 355 days.

(21) Appl. No.: 10/991,741

(22) Filed: Nov. 18, 2004

(65) Prior Publication Data

US 2005/0152790 A1 Jul. 14, 2005

(30) Foreign Application Priority Data

Nov. 20, 2003 (DE) ..... 103 54 312

(51) Int. Cl.
*F04B 17/00* (2006.01)

(52) U.S. Cl. ..... 417/423.1; 417/53; 417/353; 417/355; 417/410.1

(58) Field of Classification Search ..... 417/273, 417/423.1, 353, 355, 410.3, 371, 410.4, 366, 417/356, 53; 418/166, 168, 171
See application file for complete search history.

(56) References Cited

U.S. PATENT DOCUMENTS 6,585,498 B2 * 7/2003 Arbogast et al. ..... 417/423.1

FOREIGN PATENT DOCUMENTS

DE 1 553 116 7/1970
DE 100 15 139 10/2001

* cited by examiner

*Primary Examiner*—Devon C. Kramer
*Assistant Examiner*—Vikansha Dwivedi
(74) *Attorney, Agent, or Firm*—Ohlandt, Greeley, Ruggiero & Perle, L.L.P.

(57) ABSTRACT

A pumping unit is provided with a pump that is partially disposed in a stator of an electric motor. The rotor is at an opposite end from the pump and is connected to the pump shaft to drive it for fluid flow. The pump shaft can be positioned in a central bore of the rotor and connected thereto via a meshing gear.

10 Claims, 2 Drawing Sheets

PUMPING UNIT FOR A LIQUID MEDIUM

RELATED APPLICATIONS

This application claims priority to German Application No. DE 103 54 312.0, filed on Nov. 20, 2003, the disclosure of which is incorporated herein by reference.

BACKGROUND OF THE INVENTION

1. Field of the Invention

The invention concerns a pumping unit, which has a gear pump and an electric motor in a common housing. Such a pumping unit is also designated as a motor-driven pump or a motor-driven pumping unit.

2. Description of the Related Art

A motor-driven pumping unit is described by German Application DE 100 15 139 A1, shown in FIG. 1, and the disclosure of which is incorporated herein by reference.

The motor-driven pumping unit comprises an electric motor 1 with a rotor 11 and a stator 12. The stator 12 has a stator sheet stack 121 and a winding 122. Rotor 11 has a pot shape and is U-shaped, viewed in axial section.

A pump 2 is disposed radially inside rotor 11 and stator 12. As can be seen, this pump 2 is completely enclosed by rotor 11 or stator 12 of electric motor 1.

In order to produce a drive connection between rotor 11 and pump shaft 21, land 111 of rotor 1 has a bore with an internal gear, which engages with an external gear of pump shaft 21. The pump shaft 21 bears a pinion 22, which meshes with an internal geared wheel 23, which is disposed eccentrically to the pinion 22 within rotor 11 of electric motor 1. Side pieces 24 and 25 of pump 2 are disposed axially on both sides of internal geared wheel 23, and in this pump, pump shaft 21 is mounted in a rotatable manner by friction bearings 241 and 251.

An inlet 5 for introducing the pumping medium is provided in an end side of the housing 4. An outlet 6 for discharging the pumping medium is provided in the same end side of the housing.

The embodiment shown has been found to be easy to produce and is compact. It has been determined, however, that in the case of specific pump data, for example, in the case of a small displaced volume and low pressure, the ratio of motor dimensions to pump dimensions is unfavorable.

SUMMARY OF THE INVENTION

The object of the invention is to further develop a motor-driven pumping unit of the type described initially in such a way that an optimal and thus cost-favorable structural volume is attained even in the case of small displaced volume and low pressure.

The object according to the invention is solved by a pumping unit with the features, and the equivalents thereof, as described herein.

The solution according to the invention is based on the knowledge of the inventor that the insufficient structural volume is essentially caused by an unfavorable ratio of motor diameter to motor length. Correspondingly, the inventor has further developed the known embodiment of the pump in such a way that the ratio between motor diameter and motor length can be designed smaller. This possibility is assured in the case of the pumping unit according to the invention by the fact that the rotor of the electric motor is disposed on the end side opposite the pinion and the internal geared wheel of the pump. The drive connection between electric motor and pump will be produced in such a way that the pump is equipped with an extended pump shaft, which projects into the rotor of the electric motor. The rotor of the electric motor is mounted resistant to rotation, preferably cantilevered on a segment of the extended pump shaft. The arrangement of the pump also could be axially shifted next to the rotor of the electric motor onto a common shaft, also designated a tandem structure.

Many advantages can be achieved or retained by the embodiment according to the invention, such as, for example, the relatively small structural space necessary for the pumping unit, the forming of the motor and the pump into one integral unit, the cooling of the motor by the pumping medium, which is particularly a hydraulic oil, the comparatively great reduction in sound level, as well as the possibility of being able to separately examine the two units, i.e., pump and motor. In particular, the pumping unit according to the invention is free of any radial packing rings, ventilating fan noise, roller bearings as well as special pump supports and elastic couplings.

The rotor of the electric motor is particularly advantageously connected to the pump shaft, resistant to rotation, by means of a meshing gear on its end side or in the region of its end side. The end side of the rotor is particularly considered for the rotation-resistant connection, since it is placed at a distance in relation to the pump, i.e., it is the side placed away from the pump. For example, the pump shaft can be provided with a shaft journal, which bears an external gear that meshes with the rotor of the motor or a disk mounted in the rotor.

The pumping unit has an electric motor, a pump and a housing. The electric motor has a rotor and a stator. The rotor has a central bore. The pump conveys the liquid medium and is operably connected to and driven by the electric motor. The pump is at least partially radially inside of the stator. The pump has a shaft and an eccentric internal geared wheel. The shaft has a pinion opposite to and meshing with the eccentric internal geared wheel. The housing encloses the electric motor and the pump. The rotor is on a first end of the pumping unit that is opposite to the pinion and the internal geared wheel of the pump. The rotor is resistant to rotation with respect to the shaft by a segment of the shaft that extends axially into the central bore of the rotor.

The pumping unit can have an annular-shaped intermediate space between the rotor and the stator. The housing can have first and second end sides that are axially opposed to each other, where the first end side has an inlet for the liquid medium and the second end side has an outlet for the liquid medium. The medium can flow from the inlet axially along the stator through the annular-shaped intermediate space through the pump and out of the outlet. The pumping unit may also have a meshing gear connected to the rotor on an end of the rotor that is opposite to the pump, where the meshing gear engages with the shaft thereby allowing the rotor to drive the shaft. The pump can be only partially radially inside of a stator winding and the rotor can be inside of the stator sheet stack. The rotor can have a central bore with a first segment of the shaft being disposed through the central bore. At least one spacer sleeve can be positioned between the first segment and the rotor in the central bore. The shaft may have a second segment adjacent to the first segment that has a diameter smaller than the diameter of the second segment.

DESCRIPTION OF THE INVENTION

Figure 1:
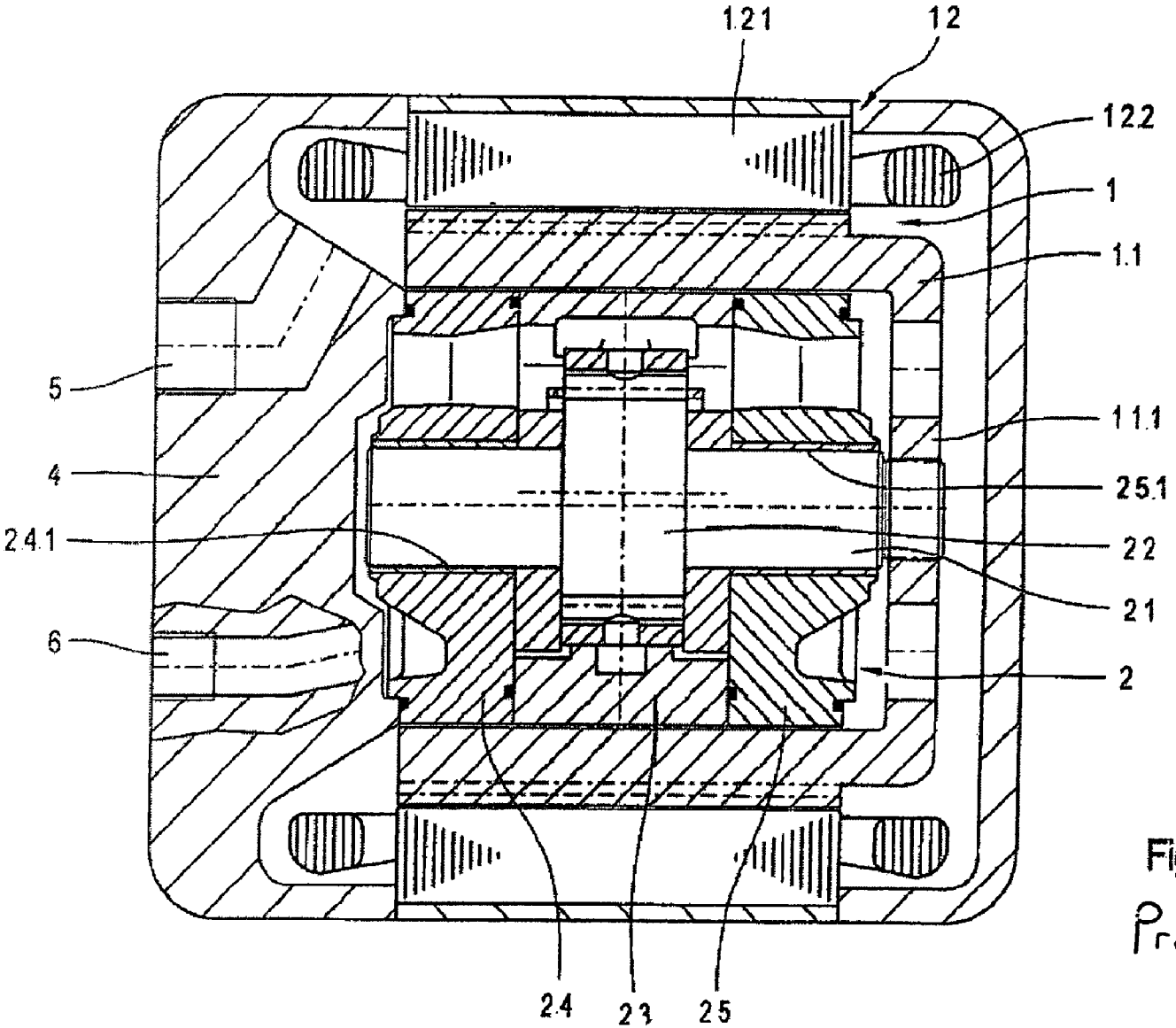
Fig.1 Prior Art
FIG. 1 shows a cross-sectional view of a motor-driven pumping unit of the prior art.
Figure 2:
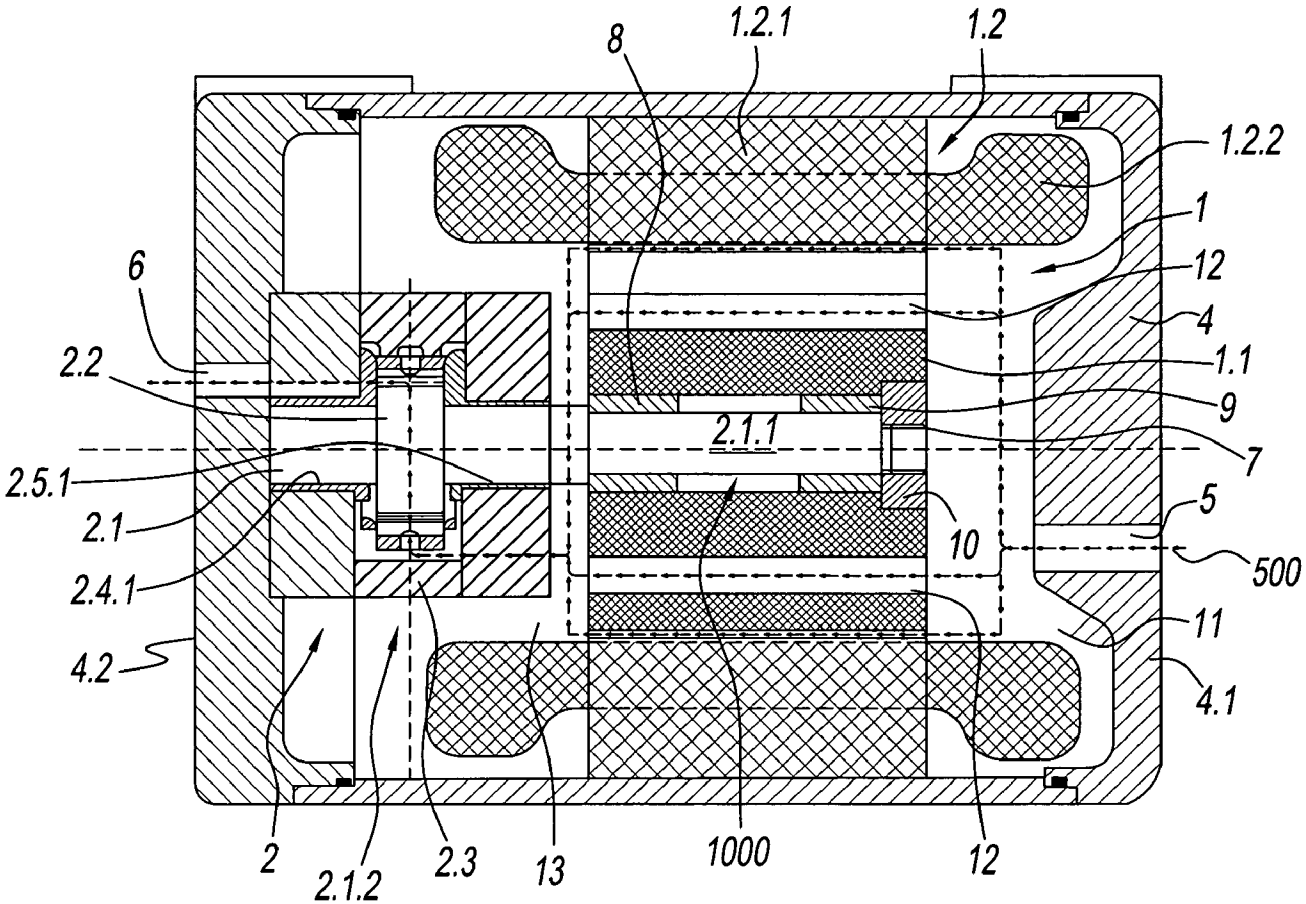
FIG. 2 shows a cross-sectional view of a motor-driven pumping unit of the present invention.

Referring to FIG. 2, pump 2 is no longer completely arranged inside stator 1.2 of electric motor 1, but rather only partly inside it, and in fact exclusively inside one axial end of the stator winding 1.2.2 and completely outside the axial region of the stator sheet stack 1.2.1.

The shaft 2.1 of pump 2 has two segments or regions, a first segment or region 2.1.1, which is allocated to the rotor 1.1 of the electric motor, and a second segment or region 2.1.2, which is allocated to the pump 2. The pump shaft 2.1 is mounted inside pump 2 in region 2.1.2, preferably by means of the friction bearings 2.4.1 and 2.5.1 on both sides of the pinion 2.2 borne by the pump shaft 2.1. The region 2.1.1 of the pump shaft 2.1, which is formed with a comparatively smaller diameter than the region 2.1.2, is completely enclosed by the rotor 1.1 (which is shaped like a hollow cylinder having a central bore 1000), and bears rotor 1.1, for example, by means of spacer pieces or spacer sleeves 8 and 9, which are shown. Rotor 1.1 of electric motor 1 is thus mounted cantilevered on pump shaft 2.1.

The rigid connection between rotor 1.1 and pump shaft 2.1 is produced by a connection 7, which is resistant to rotation. This is formed as an external gear on an axle journal at the end of pump shaft 2.1, which lies opposite the end on the pump side. A meshing disk 10 with an internal gear or locking catch, which is mechanically engaged with rotor 1.1, is shifted onto this axle journal, which has the smallest diameter of pump shaft 2.1. Due to the fact that the internal gear of meshing disk 10 and the external gear of the axle journal engage with one another, the driving power of rotor 1.1 is transferred to pump shaft 2.1 and thus to the pinion 2.2 and the internal geared wheel 2.3 which is eccentric to it.

The line for the pumping medium through housing 4 is shown by arrows 500. As can be seen, the pumping medium enters through an inlet 5 for pumping medium in axial direction in a first end side 4.1 of housing 4, is distributed in peripheral direction in an annular channel 11, which surrounds the first end of the winding 1.2.2 of stator 1.2, and then flows in the axial direction along stator 1.2 through an annular gap between stator 1.2 and rotor 1.1. In addition, axial bores 12 are provided in rotor 1.1 radially inside the annular gap, and the pumping medium is guided through these bores. After the pumping medium has passed axially through rotor 1.1, it flows into a second annular channel 13 on the other side of rotor 1.1, which surrounds the second axial end of winding 1.2.2 and pump 2.

The pumping medium is guided from this second annular channel 13 into pump 2, is compressed therein by means of the gear pump, i.e., the engagement of pinion 2.2 in the internal geared wheel 2.3, and conveyed out from housing 4 axially through the outlet 6 for pumping medium.

The present invention having been thus described with particular reference to the preferred forms thereof, it will be obvious that various changes and modifications may be made therein without departing from the spirit and scope of the present invention as defined in the appended claims.

What is claimed is:

1. A pumping unit for a liquid medium comprising: an electric motor having a rotor and a stator, said rotor having a central bore;

a pump for conveying the liquid medium and being operably connected to and driven by said electric motor, said pump being at least partially radially inside of said stator, said pump having a shaft and an eccentric internal geared wheel, said shaft having a pinion opposite to and meshing with said eccentric internal geared wheel;

a housing enclosing said electric motor and said pump, wherein said rotor is on a first end of the pumping unit that is opposite to said pinion and said eccentric internal geared wheel of said pump, and wherein said rotor is resistant to rotation with respect to said shaft by a first segment of said shaft that extends axially into said central bore of said rotor; and an annular-shaped intermediate space between said rotor and said stator, wherein said housing has first and second end sides that are axially opposed to each other, wherein said first end side has an inlet for the liquid medium, wherein said second end side has an outlet for the liquid medium, and wherein the liquid medium flows from said inlet axially along said stator through said annular-shaped intermediate space through said pump and out of said outlet.

2. The pumping unit of claim 1, further comprising a meshing gear connected to said rotor on an end of said rotor that is opposite to said pump, wherein said meshing gear engages with said shaft thereby allowing said rotor to drive said shaft.

3. A pumping unit for a liquid medium comprising: an electric motor having a rotor and a stator, said rotor having a meshing gear connected thereto;

a pump for conveying the liquid medium and being operably connected to and driven by said electric motor, said pump being only partially radially inside of said stator, said pump having a shaft and an eccentric internal geared wheel, said shaft having a pinion opposite to and meshing with said eccentric internal geared wheel;

a housing enclosing said electric motor and said pump, wherein said meshing gear is on an end of said rotor that is opposite to said pump, and wherein said meshing gear engages with said shaft thereby allowing said rotor to drive said shaft;

an inlet and an outlet, said inlet and outlet being positioned on opposite ends of the pumping unit from each other, wherein said rotor has at least one axial bore therethrough that provides fluid communication between said inlet and said outlet; and an annular-shaped intermediate space between said rotor and said stator, wherein said annular-shaped intermediate space provides fluid communication between said inlet and said outlet.

4. The pumping unit of claim 3, wherein said stator has a stator winding and a stator sheet stack, wherein said pump is only partially radially inside of said stator winding, and wherein said rotor is inside of said stator sheet stack.

5. The pumping unit of claim 3, wherein said rotor has a central bore, wherein said shaft has a first segment that is in said central bore, and wherein between said first segment and said rotor in said central bore is at least one spacer sleeve.

6. The pumping unit of claim 5, wherein said shaft has a second segment adjacent to said first segment, wherein said second segment is connected to said pinion inside of said pump, and wherein said first segment has a first diameter that is smaller than a second diameter of said second segment.

7. A method of pumping a liquid medium comprising:

providing a rotor of an electric motor at a first end of a housing;

positioning a pump partially inside of a stator of said electric motor at a second end of said housing that is opposite to said first end;

providing power to said electric motor to drive said pump via a meshing gear that is connected between a shaft of said pump and said rotor thereby causing flow of the liquid medium from said first end to said second end, wherein said liquid medium flows through an annular-shaped intermediate space between said rotor and said stator; and surrounding said rotor with first and second annular channels on opposing sides of said rotor, wherein said first annular channel is in fluid communication with an inlet of the housing and said second annular channel is in fluid communication with an outlet of said housing.

8. The method of claim 7, wherein said liquid medium flows through at least one bore in said rotor.

9. The method of claim 7, further comprising positioning said pump partially radially inside of a stator winding of said stator, and positioning said rotor inside of a stator sheet stack of said stator.

10. The method of claim 7, further comprising positioning said shaft through a central bore of said rotor using at least one spacer sleeve between said shaft and said rotor.

* * * * *